United States Patent [19]

Cannon

[11] 3,932,853

[45] Jan. 13, 1976

[54] APPARATUS FOR WARNING OF THE FAILURE OF A SUMP PUMP

[76] Inventor: Richard A. Cannon, 4752 Broad Road, Syracuse, N.Y. 13021

[22] Filed: Apr. 30, 1974

[21] Appl. No.: 465,492

[52] U.S. Cl. ..... 340/244 B; 210/91

[51] Int. Cl.[2] ..... G08B 21/00

[58] Field of Search ..... 340/244 B, 214

[56] References Cited

UNITED STATES PATENTS

| | | | |
|---|---|---|---|
| 350,279 | 10/1886 | Wickersham | 340/244 B |
| 2,777,030 | 1/1957 | MacGritt | 340/214 |
| 2,816,973 | 12/1957 | Beck | 340/244 B |

*Primary Examiner*—Thomas B. Habecker
*Attorney, Agent, or Firm*—D. Peter Hochberg

[57] ABSTRACT

Apparatus for warning of the failure of a sump pump comprising an electrical alarm connected in an electric circuit, a switch for closing the circuit to activate the alarm, and a movable float positioned in the sump for actuating the switch when the water level in the sump reaches a height indicative of sump pump failure.

1 Claim, 3 Drawing Figures

APPARATUS FOR WARNING OF THE FAILURE OF A SUMP PUMP

BACKGROUND OF THE INVENTION

Field of the Invention

The present invention relates to a warning device for indicating the failure of a sump pump.

Description of the Prior Art

Residential buildings and other edifices frequently have incorporated in the lowest level thereof a sump which serves as a drain for ground water, rain water, etc. entering the structure through the walls or base thereof. In order to keep the water from overflowing the sump and entering the lowest floor of the structure, a sump pump is usually provided for draining water from the sump. This sump pump is generally either mounted within the sump itself or else at a distance above the sump. In order to conserve energy, means are generally provided for activating the sump pump only when a certain amount of water is detected in the sump, so that the water level is prevented from exceeding a predetermined level.

If the sump pump should fail, either by becoming completely inoperative or by operating at reduced capacity, serious damage and great inconvenience may occur if water overflows the sump and enters the base floor of the structure. The occupant of a building generally only learns of the failure of his sump pump when the basement becomes flooded or when by chance he happens to note that the sump pump has failed. Therefore, the failure of a sump pump is frequently accompanied by expensive repairs, both to the sump pump itself and to the structure in which it is used.

It is known in other arts to activate warning devices to indicate high or low liquid levels in tanks or compartments. For example, there are float-operated warning devices used in association with steam boilers, hulls of ships, drip pans, and oil or gasoline tanks. Nevertheless, it has heretofore been unknown to indicate the failure of a pump for draining the sump in a building through the detection of a high level of water in the sump.

SUMMARY OF THE INVENTION

It is an object of the present invention to provide means for warning of the failure of a sump pump.

A further object of the invention is to provide an apparatus of the foregoing type which is effective and reliable in operation.

Another object of the invention is to provide a device for warning of the failure of a sump pump, which is simple in construction and economical to manufacture.

Other objects will be apparent from the description to follow and from the appended claims.

The foregoing objects are achieved according to the preferred embodiment of the invention by the provision of apparatus comprising an electrical alarm connected in a battery-energized circuit for emitting a warning signal when the circuit is closed, a float assembly disposed in a sump and movable in response to changes of the water level in the sump, and a switch for closing the electric circuit when the float moves to a position indicating that the sump pump is not removing water from the sump at a sufficient rate.

DESCRIPTION OF THE PREFERRED EMBODIMENT

The apparatus described below comprises a housing containing an electrical alarm and a storage battery, a float assembly disposed in a sump and movable in response to changes in the level of water in the sump, and a mercury switch mounted on the float and arranged to close an electrical circuit across the alarm when the water level in the sump reaches a predetermined high level indicative of failure of a sump pump used for draining the sump.

Figure 1:
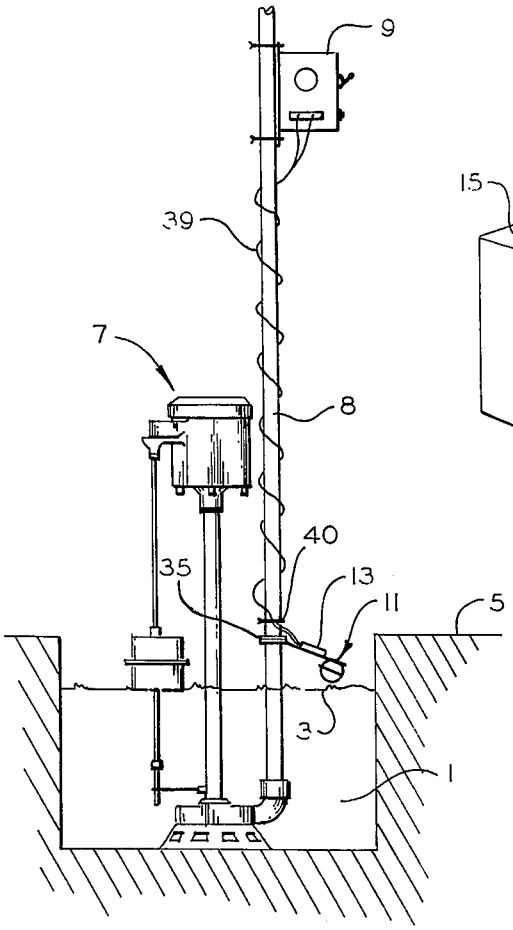
FIG. 1 shows apparatus according to the present invention in a side view as used in conjunction with a sump pump.

Referring now to the drawings, there is shown in FIG. 1 a sump 1 disposed in the lowest level of a building for receiving drain water. The level of the water in the sump is indicated by the numeral 3. Should water level 3 overflow sump 1 and flow onto the base floor 5 of the building, serious damage could occur. Therefore, a sump pump 7 is provided for pumping enough water from the sump through a discharge pipe 8 to prevent water level 3 from reaching a predetermined high level. Sump pump 7 can be of any conventional type, and can have a switch for actuating the pump only when water level 3 exceeds a predetermined level.

Also shown in FIG. 1 is an apparatus for warning of the failure of the sump pump. This apparatus comprises a housing 9 which contains an electrical alarm and a storage battery, a float assembly 11 which is movable in response to changes in water level 3 (once the water level has reached a certain position in the sump), and a mercury switch 13 which closes the electrical circuit across the alarm when float assembly 11 has moved an amount indicative of failure of the sump pump.

Figure 2:
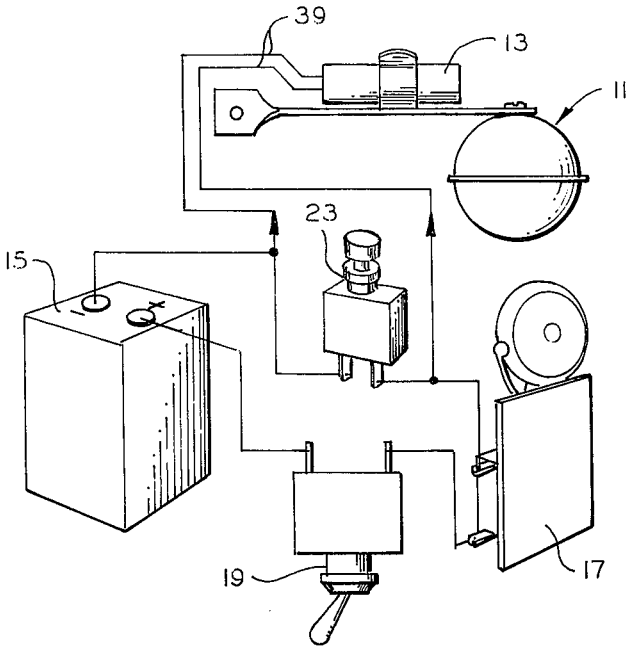
FIG. 2 shows in schematic form the electrical circuitry incorporated in the apparatus shown in FIG. 1.

The electrical components of the warning apparatus are shown in FIG. 2. These components include a storage battery 15, an electrical alarm 17 which emits an audible signal when the alarm is connected in an electrical circuit, an on-off switch 19 which is used to selectively activate or deactivate the system, and mercury switch 13 for completing a circuit across electrical alarm 17 in response to the movement of float assembly 11 as described below. Under normal conditions, i.e. when the sump pump 7 is functioning properly, mercury switch 13 keeps the circuit open. A test switch 23 is also incorporated in this circuit to determine whether the charge in storage battery 15 is sufficiently strong to operate the system. Each of the foregoing components is of conventional construction, and can be acquired with ease at many commercial establishments.

Figure 3:
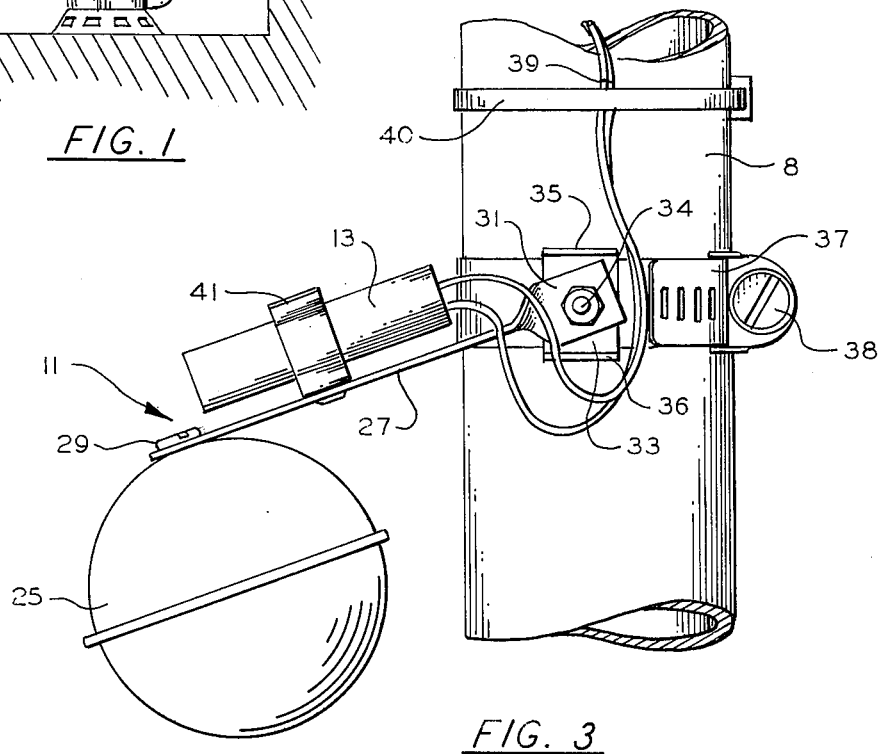
FIG. 3 is a detailed pictorial view of a float assembly used on the apparatus shown in FIG. 1.

Float assembly 11 is shown in detail in FIG. 3. This assembly includes a float 25 which can be fabricated from any material which is buoyant in water such as polyurethane, a hollow plastic, wood, etc. Cost, availability, strength, and ease of manufacture dictate the material actually used. Float 25 is connected to an arm 27 by a fastener 29. Arm 27 has a flat end portion 31 which is pivotally attached to a support plate 33 by a fastener 34. Upper and lower flanges 35 and 36 on plate 33 constrain the angle of rotation of arm 27. Plate 33 is held fast to drainage pipe 8 by a strap 37. Strap 37 is preferably fabricated from a corrosion resistant material such as stainless steel or a strong plastic, and is held tightly on generally vertically extending sump pump structure such as pipe 8 by an appropriate fastener 38. Each of the components of float assembly 11 is readily available in hardware establishments.

Mercury switch 13 is of conventional construction and comprises a glass bulb containing a drop of mercury and a pair of probes at one end of the bulb connected to electrical wires forming an electrical lead 39 included in the electrical circuitry of the system. Lead 39 is secured to drainage pipe 8 by means of a second strap 40 and is twisted about the pipe as shown in FIG. 1, to render it unobstructive. When the mercury switch is inclined so that drop of mercury connects the two probes, a circuit is completed through the switch, whereas when the switch is inclined in the opposite direction, the mercury flows away from the probes and leaves them disconnected. Mercury switch 13 is preferably encapsulated to protect it against damage. It is mounted on float arm 27 by a strap 41 and its inclination varies with the pivotal movement of arm 27. When arm 27 is inclined as shown in FIG. 3, the mercury switch remains open. Only when arm 27 passes the horizontal position does the mercury switch close by virtue of the mercury flowing towards the two probes.

Operation of the apparatus is straightforward and effective. The apparatus is attached to discharge pipe 8 as indicated in FIG. 1. Particular care must be taken to secure strap 35 around discharge pipe 8 so that float 25 is located at a position coincidental with the highest water level allowable in sump 1, which normally would be the level at which pump 7 maintains the water or prevents the water from exceeding when the pump is working properly. After installation of the apparatus, on-off switch 19 should be turned on so that a circuit will be completed through electrical alarm 17 only when mercury switch 13 becomes inclined sufficienty to close the circuit including the alarm. When the pump 7 is functioning properly, no current will be drawn from storage battery 15. Since the apparatus may go for long periods without being activated, it may be desirable from time to time to actuate test switch 23 to complete a circuit through electrical alarm 17 to determine whether the alarm and the storage battery are functioning properly.

When sump pump 7 fails to remove water at a faster rate than the water is entering the sump, water level 3 rises. When water level 3 reaches float 25, it carries float 25 upwardly causing arm 27 to pivot clockwise. When arm 27 passes the horizontal position, mercury switch 13 closes to complete a circuit across electrical alarm 17, causing the alarm to generate its audible signal.

Alarm 17 should be selected and placed so that occupants of the structure are given effective warning of sump pump failure. The use of a storage battery as an energy source for the alarm is preferred over the normal power supply to the structure, since a common source of electrical sump pump failure will normally be a general power failure. In household residences, the present apparatus would be particularly useful at night when occupants of the residence would be unaware of such a general power failure.

The apparatus described above thus provides an economical and reliable warning system for indicating failure of a sump pump, and achieves the objects set forth above. It can be constructed and installed with ease, and at a low expense.

The invention has been described in detail with particular reference to a preferred embodiment thereof, but it will be understood that variations and modifications can be effected within the spirit and scope of the invention.

I claim:

1. Apparatus for warning of the failure of a sump pump for pumping water from a sump, the sump having a discharge pipe extending vertically from the sump, said apparatus comprising:

a normally open electric circuit having a storage battery as a source of electricity;

an electrical alarm in said electric circuit for emitting a warning signal in response to the closing of said electric circuit;

float means positioned in the sump for moving with the level of water in the sump, said float means comprising a support arm pivotally mounted at one end on said discharge pipe, and a float attached to the other end of said support arm for effecting the rotation of said support arm in response to changes in the level of water in the sump;

constraining means for constraining the rotation of said support arm, said constraining means being mounted on said discharge pipe;

a mercury switch mounted on said support arm for closing said electric circuit in response to movement of said float means above a position coincident with a water level in the sump indicative of sump pump failure, for closing said electric circuit to effect the emission of said warning signal; and a test switch connected in said circuit for selectively closing said electric circuit to determine whether said storage battery is of sufficient strength to activate said electrical alarm.

* * * * *